US008011469B2

(12) United States Patent
Olson

(10) Patent No.: US 8,011,469 B2
(45) Date of Patent: Sep. 6, 2011

(54) TUNABLE SOUND TRANSMISSION DEVICE FOR A MOTOR VEHICLE

(75) Inventor: Brad Olson, Plainwell, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 12/641,655

(22) Filed: Dec. 18, 2009

(65) Prior Publication Data

US 2011/0147116 A1 Jun. 23, 2011

(51) Int. Cl.
*F02B 77/13* (2006.01)
*F02M 35/10* (2006.01)

(52) U.S. Cl. ..... 181/204; 123/184.53; 123/184.57

(58) Field of Classification Search ..... 181/204; 123/184.53, 184.57
See application file for complete search history.

(56) References Cited

U.S. PATENT DOCUMENTS 3,798,393 A * 3/1974 Gorike ..... 381/372
4,440,983 A * 4/1984 Facoetti et al. ..... 381/190
5,307,767 A * 5/1994 Schutz ..... 123/184.57
6,600,408 B1 * 7/2003 Walter et al. ..... 340/384.1
6,848,410 B2 * 2/2005 Hoffmann et al. ..... 123/184.57
7,658,263 B2 * 2/2010 Jasnie et al. ..... 181/204
2006/0283658 A1 * 12/2006 Abe et al. ..... 181/204
2009/0250290 A1 * 10/2009 Jasnie et al. ..... 181/204

FOREIGN PATENT DOCUMENTS

DE 4435296 4/1996
DE 19930025 11/2000
DE 10116169 10/2002

* cited by examiner

*Primary Examiner* — Elvin G Enad
*Assistant Examiner* — Christina Russell
(74) *Attorney, Agent, or Firm* — James Hasselbeck

(57) ABSTRACT

A tunable sound transmission device for transmitting an engine rumble sound into an interior of a motor vehicle includes a transmission line having a first end in acoustic communication with an air intake tract of an engine. A flexible membrane is positioned to sealably close off a portion of the transmission line thereby dividing the transmission line into two portions that are airflow isolated from each other. A receptacle is arranged at the second end of the transmission line and a user changeable sound characterization device is replaceably installed into the receptacle. The sound characterization device is configured and adapted to provide an intended frequency dependent sound attenuation characteristic and an overall sound dampening level for the transmitted engine sound.

13 Claims, 2 Drawing Sheets

TUNABLE SOUND TRANSMISSION DEVICE FOR A MOTOR VEHICLE

TECHNICAL FIELD

The invention relates to sound transmission devices for conducting engine sound towards or into the passenger compartment of a motor vehicle and, more particularly, to a sound transmission device incorporating an end user changeable device operable to selectively tune the frequency spectrum and sound dampening of the transmitted sound.

BACKGROUND OF THE INVENTION

Devices configured to transmit engine sound from the engine compartment of a motor vehicle into the passenger compartment are known. In one known configuration a sound transmission device includes a flexible tube or pipe in which one end is connected into the air intake tract of the engine and an opposing end is positioned near or extending through the firewall into the passenger compartment.

As a drive unit, modern motor vehicles have internal combustion engines that operate very smoothly so that the engine operating sound may be barely audible within the interior of the motor vehicle. As designs evolve to address lower $CO_2$ emissions and improved fuel economy, smaller engines are utilized together with lighter weight vehicle designs. The reduced operating sound of the internal combustion engine may be further obscured by other secondary noises such as road noises, vehicle HVAC systems, etc.

Under certain circumstances it can be desirable to transmit the operating sound of the internal combustion engine to the interior of the motor vehicle. Engine sound may be channeled through the sound transmission device to provide a "sporty" engine sound experience to the driver and passengers. In some cases the sound output of the sound transmission device is relatively low in volume with the result that it is sometimes desirable to extend the sound transmission device tube into the vehicle interior from the engine compartment to thereby improve the transmitted engine sound amplitude level for an improved driver experience.

It is known to provide a flexible diaphragm in the sound transmission tube to provide airflow isolation, thereby preventing airflow through the sound transmission tube. Even if the sound tube is not extended into the passenger compartment, it is undesirable to permit airflow back into the engine air intake tract through a sound transmission tube for which the purpose is strictly to conduct sound. This is especially undesirable if the sound tube is connected to the clean side of the air filter as any airflow through the tube would be introduced as unfiltered air into the air intake tract.

It is known to provide tuning of a transmitted sound spectrum in a vehicle sound transmission device by the addition of a quarter wave tuner or a resonator chamber in the sound transmission tubing. A quarter wave tuner is useful to attenuate or cancel a selected transmitted sound frequency. The quarter wave tuner may be positioned and connected to the sound transmission tubing so as to extend outwards from the tubing in a branch configuration, typically (although not necessarily) at about 90 degrees relative to the axis of the sound transmission tubing. Alternately, when it is desired to amplify a selected transmitted sound frequency then an inline resonator chamber may be provided in the sound transmission tubing. If the inline resonator is configured with a duct length L, then the amplified sound wavelength will be a function of L/2. The use of quarter wave tuners and inline resonators, alone or in combination, permit the transmitted sound to be tailored using only passive devices rather than by the application of more expensive and complicated active electronic devices.

Published U.S. patent application Ser. No. 12/061,703 discloses a device for noise transmission in a motor vehicle. In this device sound is transmitted along a transmission line having an enlarged mouth at one end and a diaphragm fitted to close off the mouth. A protective device is fitted at the end to protect the diaphragm.

U.S. Pat. No. 6,600,408 B1 discloses a device for sound transmission for a motor vehicle. In this device, the sound is transmitted along a pipe conduit and a chamber in which a diaphragm is arranged toward the interior of the motor vehicle. The chamber that surrounds the diaphragm is comprised of several assembled parts.

German patent publication DE 101 16 169 A1 discloses a resonator chamber in which the diaphragm is arranged.

German patent DE 44 35 296 discloses a diaphragm for noise transmission in a motor vehicle in which the diaphragm is clamped in a holder.

U.S. published patent application 2006/0283658 A1 discloses a system for noise increase of an intake system of a motor vehicle. Various possibilities of noise introduction into the interior of the motor vehicle are illustrated wherein the diaphragm is arranged in a pipe conduit for noise transmission.

In the German publication DE 199 30 025 A1 a sound transmission body is illustrated in which the diaphragm is clamped between two transmission members.

SUMMARY OF THE INVENTION

In multiple aspects of the invention a tunable sound transmission device for transmitting an engine rumble sound into an interior of a motor vehicle includes a transmission line having a first end in acoustic communication with an air intake tract of an engine. A flexible membrane is positioned to sealably close off a portion of the transmission line thereby dividing the transmission line into two portions that are airflow isolated from each other. The membrane, thus installed, is operable to communicate sound between the portions while preventing airflow between the portions. A receptacle is arranged at the second end of the transmission line. A sound characterization device is replaceably installed into the receptacle. The sound characterization device is configured and adapted to provide an intended frequency dependent sound attenuation characteristic and an overall sound dampening level for the sound transmission device. The sound characterization device is tunable by replacing the sound characterization device with another sound characterization device configured and adapted to provide at least a differing one of the transmitted sound spectral frequency response and desired overall sound dampening level.

In another aspect of the invention, the receptacle is arranged within a passenger compartment of a motor vehicle to deliver the engine rumble sound therein.

In another aspect of the invention, the sound characterization device comprises one or more varieties of polyurethane foam.

In another aspect of the invention, the sound characterization device is calibrated to achieve the desired transmitted sound spectrum and the desired overall sound dampening level by adjusting at least one of: foam material composition, cell size, cell open ratio, thickness, stiffness, total air volume in the foam, and foam material density.

In another aspect of the invention, the sound characterization device comprises at least one additional foam layer positioned in series with the first foam layer; the additional foam layers each differing in at least one of: foam material composition, cell size, cell open ratio, thickness, stiffness, total air volume in the foam, and foam material density relative to other layers. The additional layers are operable to further characterize the transmitted sound frequency spectrum and the desired overall sound dampening level.

In another aspect of the invention, the additional layers are operative to provide at least one bandgap in the transmitted sound frequency spectrum, the bandgap calibrated to attenuate undesired frequencies.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
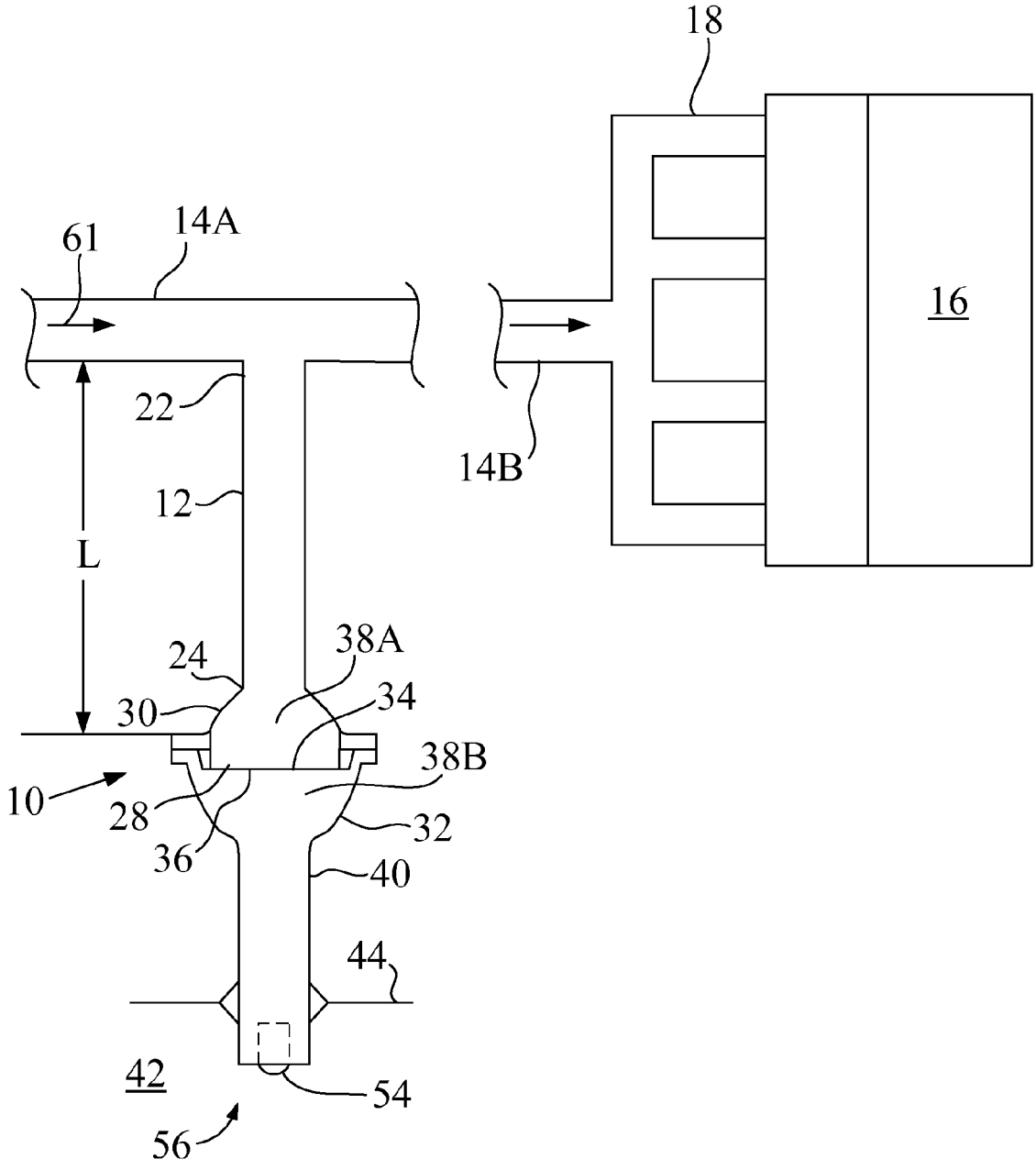
FIG. 1 schematically depicts a sound transmission device connected into the engine air intake tract of a motor vehicle and transmitting sound into the interior of the motor vehicle, consistent with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a tunable sound transmission device for transmitting an engine rumble sound into the passenger compartment of a motor vehicle as disclosed herein. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 schematically depicts a sound transmission device 10 having a first transmission line 12 connected at one end 22 to an air intake tract 14A of an internal combustion engine 16. Air intake tract portions 14A and 14B may have interposed there-between additional components such as a throttle body (not shown) or possibly an air filter or air cleaner (not shown). For better sound performance, preferably the first transmission line connects to the air intake tract 14A in a location downstream of the air filter (not shown) so that in FIG. 1 (for this case) the air cleaner would be positioned upstream (relative to air flow) of the air intake tract 14A portion illustrated (air flow direction illustrated by arrow 61).

In the illustrated embodiment, the opposing end 24 of the first transmission line 12 is in airtight connection with a lower trumpet 26. A flexible membrane 28 is secured and tensioned to close off the trumpet rim 30 at a first side 34 of the flexible membrane 28. An upper trumpet 32 in configured and adapted to seal against an opposing second side 36 of the flexible membrane 28. The trumpets 26 and 32 define cavities 38A and 38B in which the flexible membrane 28 is free to deflect in response to acoustic pressure pulsations transmitted along first transmission line 12 from the engine 16. Although preferred, the present invention is not limited to sound transmission devices utilizing trumpets. In the present invention the membrane may be installed into the sound transmission device using a variety of other means as would be known to those skilled in the art.

The upper trumpet 32 may connect to a broadcast duct 40 that may in some aspects extend into the passenger compartment 42 through the firewall 44. In other aspects of the invention the broadcast may terminate inside the engine compartment and proximate to the firewall 44. In still other aspects of the invention, the broadcast duct may be omitted and the diaphragm 28 (or membrane) instead positioned to radiate sound within the engine compartment towards the passenger compartment 42 of the motor vehicle. In additional aspects of the invention, the trumpet 26 and 32 may be omitted and the sound transmitting membrane closes over the end 24 of the transmission line 12. The end 24 of the transmission line 12 may be of larger diameter than the transmission line 12 so as to form an enlarged diameter mouth over which the membrane 28 is closeably tensioned. In further aspects of the invention the transmission line 12 and the lower trumpet 26 may be formed as a unitary component by a plastic molding process such as injection molding. Similarly, in additional aspects of the invention the upper trumpet 32 and broadcast duct 40 may be formed as a unitary component by a plastic molding process such as injection molding. Components may be configured and arranged in other ways utilizing the principles taught in the present disclosure without deviating from the inventive concepts and present invention disclosed herein.

In one aspect of the present invention, a sound characterization device 54 is arranged at a position along the length of and in line with the broadcast duct 40. It is preferred that the broadcast duct 40 terminate within the passenger compartment 42 as this will provide the cleanest and potentially loudest engine sound experience to the vehicle passengers. In other aspects of the invention the broadcast duct may instead terminate within the engine compartment of the vehicle, in which case it is preferable to position the outlet end 56 of the broadcast duct proximate to and positioned to direct sound towards the vehicle firewall 44. As will be explained further below, the sound characterization device 54 is tunable by an end user or customer to further modify the frequency spectral response of the sound transmission device and to provide a desired amount of overall sound dampening.

Figure 2:
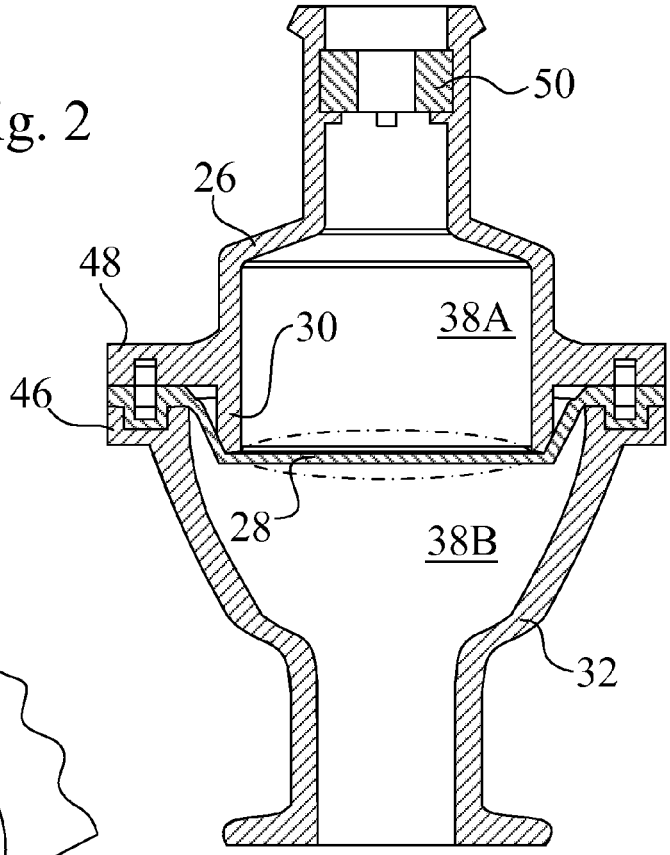
FIG. 2 is a sectional side view of a sound transmission device having an upper and lower trumpet assembly with a sound transmitting membrane, consistent with the present invention.

In accordance with at least one aspect of the present invention, FIG. 2 depicts a sectional side view of the lower trumpet 26 having the flexible membrane 28 tensioned onto and closing over the rim 30 of the lower trumpet 26. The upper trumpet 32 is provided with flanges 46 configured to compressively and sealably engage peripheral portions of the membrane 28 against the flanges 48 of the lower trumpet 26, tensioning the membrane 28 onto and over the rim 30 of the lower trumpet 26. The membrane 28 provides an airtight separation between the cavities 38A and 38B and may be tensioned to tune the transmitted sound spectrum.

In some aspects of the present invention throttles 50 may be provided at either the lower or upper trumpet. Throttles 50 further restrict acoustic air pressure pulsations through sound transmission device 10 and are operable to further tune the transmitted sound spectrum. Acoustic pressure pulsations in the air intake tract are communicated by the first transmission line 12 to into the cavity 38A where they act to sympathetically displace or flex the membrane 28. Flexure of the membrane 28 re-transmits acoustic pressure pulsations into the otherwise isolated cavity 38B where they may then be transmitted to the driver and passengers of the vehicle interior 42 through the broadcast duct 40.

The normal operation of the engine 16 produces air pressure pulsations within the air intake manifold 18. These pulsations are conducted through the air intake duct (14A and 14B). The first transmission line 12 is arranged and configured in airflow communication with the intake tract 14A. The first transmission line 12 may be advantageously configured to have a length and air volume such that the first transmission line 12 has a desired resonant sound frequency selected to amplify a selected frequency range of air pressure pulsations generated by the engine. When this is the case, then the amplitude of the sound pressure pulsations in the first transmission line 12 which occur about the selected frequency range may be amplified above the sound pressure level present in the intake tract 14A. In a similar way it is possible to configure the length and volume of the broadcast duct 40 (if present) to have a desired resonant sound frequency selected to amplify a selected frequency range of air pressure pulsations generated by the engine. Preferably the resonant frequency of the first transmission line 12 matches the resonant frequency of the broadcast duct. Although preferable, this is not necessary to the invention. Selection of the resonant frequencies of the ducts 12 and/or 40 enables one way in which the frequency spectral response of engine sound transmitted to the passenger compartment 42 may be calibrated.

Depending on the application and for obtaining the corresponding mechanical properties, the flexible membrane 28 may be made of rubber film, fabric or plastic film or may also be a metal foil or a thin sheet metal. In a preferred embodiment in the present invention, the diaphragm 28 is comprised of a rubber material, for example, ethylene propylene diene rubber (EPDM), silicon rubber (VMQ), fluorosilicone rubber (FVMQ), fluoropolymer rubber (FPM or FKM) or other suitable flexible materials as are known to those skilled in the art.

Particularly for elastic diaphragm materials such as varieties of rubber, the height of the rim 30 relative to the flange 48 may be configured to result in a specific desired (intentional) tension in the membrane 28. The tension in the membrane 28 may be selected to tune the acoustic flexure properties of the membrane 28 and therefore is an additional means of adjusting how the sound amplitude vs. frequency spectrum in cavity 38B may intentionally deviate from the sound amplitude vs. frequency spectrum in cavity 38A.

Another way in which the acoustic flexure properties of the membrane 28 may be tuned or adjusted is by varying the thickness (and therefore mass and stiffness) of the membrane 28, thereby tuning how the sound amplitude vs. frequency spectrum in cavity 38B may intentionally deviate from the sound amplitude vs. frequency spectrum in cavity 38A in advantageous and desirable ways. Additionally, the acoustic flexure properties of the membrane 28 may be modified by using a different membrane material having different properties; a few example properties including elasticity, mass, and stiffness, all of which can have an effect on the transmitted sound frequency spectrum.

By intelligent and intentional selection of the above tuning parameters, the frequency spectral response of the engine "rumble" sounds delivered to the passenger compartment may be adjusted to provide a desirable, more powerful, sports car sound to the driver and passengers.

Sound transmission systems such as described herein may be referred to as passive systems. By passive we mean that the spectral frequency (sound amplitude vs. frequency) of the sound delivered to the passenger compartment is adjusted and selected amplification is provided without the use of active components such as, for example, electronic amplifiers utilizing low pass, high pass and/or band pass filters.

While these sound transmission systems may be preconfigured during manufacturing to provide an intended engine sound spectral response to the driver, individual drivers or customers may in reality have differing requirements and wishes regarding what is a desired sound spectral response and sound level in the passenger compartment. Therefore it is an object of the invention to provide a means for a driver or customer to adapt or tune the spectral response and sound level of engine sounds delivered to the passenger compartment in personal and pleasing ways.

Figure 3A:
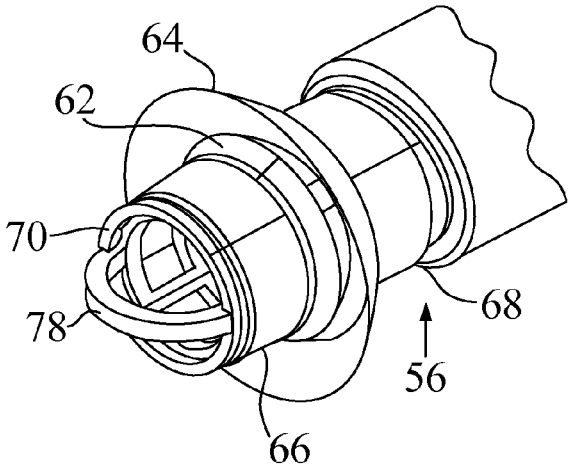
FIG. 3A depicts a sound characterization device arranged at the outlet end of the broadcast duct according to at least one aspect of the invention.

FIG. 3A depicts a sound characterization device 54 arranged at the outlet end 56 of the broadcast duct 40 according to at least one aspect of the invention. In the specific embodiment illustrated in FIG. 3A, the outlet end 56 is further equipped with a snap member 62 and a seal shroud 64. In the embodiment of FIG. 3A, the outlet end 56 is cylindrical in shape and is configured for snap-lock installation into a compatibly sized bore hole provided in the vehicle firewall 44. The annular snap member 62 is at least somewhat elastic and includes a tapered face with a diameter larger than the bore hole in the firewall such that during installation of the outlet end 56 through the bore hole in the firewall the snap member 62 is partially compressed. When the snap member passes through the bore hole into the passenger compartment side of the firewall 44, the resilient snap member 62 returns to its original shape thereby lockably mounting the outlet end 56 of the broadcast duct 40 into the firewall 44 with the sound characterization device 54 positioned inside the passenger compartment 42. When the outlet end 56 is lockably mounted into the firewall 44, the seal shroud 64, which when unstressed extends forwards towards the outlet end 56 over the snap member 62, is elastically deformed to seal against the engine compartment side of the firewall 44 to prevent dust and vapors from entering the passenger compartment from the engine compartment.

In one aspect of the invention illustrated in FIG. 3A, the snap member 62, seal shroud 64 and receptacle 66 may be realized in a separate receptacle body 68 which is permanently or removeably secured to the outlet end 56 of the broadcast duct. In other aspects of the invention the receptacle body 68 may be realized in one piece with the broadcast duct 40, such as by an injection molding process (for example).

Figure 3B:
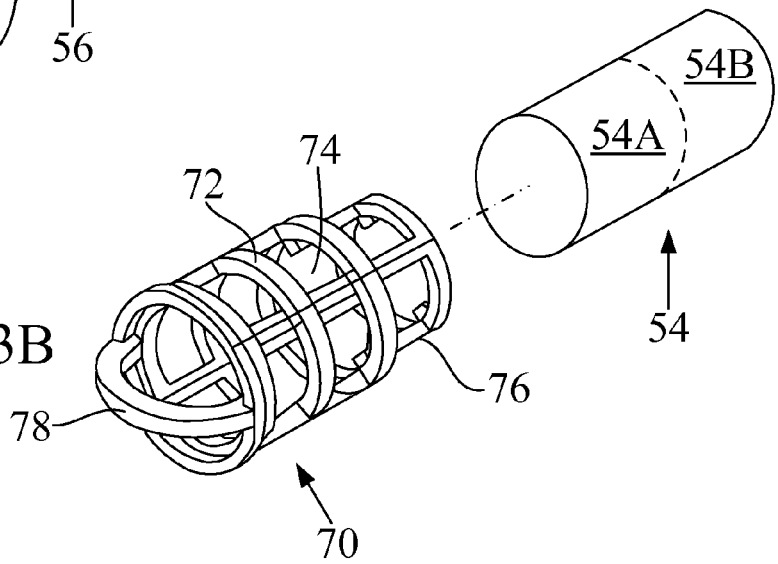
FIG. 3B is a cage carrier member configured to receive the user changeable tunable sound characterization device and installable into the receptacle at the outlet end of the sound tube.

Also depicted in FIG. 3A and shown separately in FIG. 3B is a cage carrier member 70. The cage carrier member 70 may be substantially cylindrical in shape (as shown in FIG. 3B) or may have a multiplicity of other shapes, for example square or hexagonal. The shape and size of the cage carrier member 70 is chosen to snugly and retentively mount within the receptacle 66. The containment ribs 72 of the cage carrier member 70 are positioned to define a longitudinal open space 74 therein to removably receive a sound characterization device 54 within the cage. In one aspect of the invention, the sound characterization device 54 may comprise a cylindrical block of soft polyurethane foam material having specifically intentionally selected properties as will be described further below.

Secured onto one end of the carrier cage member is a finger grip member 78. As can best be seen in FIG. 3A, the finger grip member 70 is shaped to extend outwards beyond the end of the receptacle body 68 to provide a graspable handle that may be gripped with an opposing finger and thumb (for example) to operably insert or remove the carrier cage member 70 from the receptacle 66 of the receptacle body 68.

Arranged at an opposing end of the carrier cage member 70 may be a retention neck 76 having a smaller internal diameter than provided by the containment ribs 72 encircling the open space 74. Preferably the diameter of the sound characterization device 54 is greater than the inside diameter of the retention neck 76 such that when the sound characterization device 54 is compressed and installed into the carrier cage member through the retention neck, the shroud characterization device 54 then re-expands in diameter in the open space 74, thereby removeably mounting the sound characterization device 54 in the carrier cage member 70 between the finger grip member 78 and the retention neck 76.

As discussed earlier above, advantageously the sound characterization device 54 is tunable by an end user or customer to further modify the frequency spectral response of the sound transmission device and to provide a desired amount of sound dampening. A portion of the spectral response and delivered sound pressure level is determined by other selectable parameters such as duct length, duct air volume, membrane tensioning, membrane stiffness, membrane density, etc. as discussed earlier with FIG. 1. These factors however, once selected by an engineer or manufacturer, may be difficult to change and unrealistic for an end user or customer to modify. Advantageously, the sound transmission device incorporating the replaceable sound characterization device 54 provides the end user or customer with the opportunity to easily calibrate the spectral frequency response and sound level (sound dampening) of the engine sound delivered to the passenger compartment by the sound transmission device.

It is therefore an object of the invention to provide a user configurable sound characterization device (in some embodiments using varieties of foam elements and foam element having differing properties used in serial arrangement) for sound-dampening and spectral frequency characterization which overcomes the above-mentioned disadvantages of the heretofore-known devices and methods of this general type.

According to one advantageous aspect of the invention, the sound characterization device 54 may comprise a resilient soft polyurethane foam material wherein the resilient foam material expands in the carrier cage member 70 to block off the outlet end 56 of the broadcast duct 40.

Solid foams may be used in sound control applications, more often for sound adsorption (or dampening). Open-cell foams are generally chosen for this application, and the attenuation of sound is due to both the viscosity of the air as it moves through the small pores in the foam (forming restrictions to the flow of air pressure pulses), and the attenuation of sound vibrations by the material itself. For sound reflection, however, foams are not usually used since their low density generally does not provide a sufficiently large impedance mismatch with air (i.e. too much of the energy is adsorbed).

For one example discussing theory, the paper "Sound Propagation in 2D Cellular Structures" by Erin Miller and Suhasini Gururaja of the University of Washington discloses general mathematical modeling methods for studying the propagation of sound through porous foam structures. One can study sound transmission by calculating the normal modes of the system. A normal mode is a collective motion wherein all points in a material vibrate at the same frequency. All motions of the material can be expressed as a superposition of normal mode motions. Incident sound waves at frequencies at which no normal modes exist are reflected rather than transmitted (such as through the sound characterization device).

A simple example of a normal mode calculation is the system of masses M connected by springs of spring constant k, at an equilibrium distance a apart. The displacement of mass i about its equilibrium position is given by $u_i$. The potential energy in the system is just the summation over i of the spring energies, $$U = (k/2)\sum_i [u_i - u_{i+1}]^2 \tag{1}$$

In normal mode, each mass should oscillate at the same frequency. The system of equations in matrix form can then be written:

$$[-M\omega^2 + kJA = 0 \tag{2}$$

where M is the (diagonal) mass matrix, A is the vector of displacement amplitudes for each mass i, and k is the spring constant matrix (not diagonal) which couples the masses together.

A similar system helps to illustrate how frequency band gaps may be formed in the transmitted sound with a sound characterization device of the present invention. Consider a similar mass-spring system, but with each individual mass (above) instead replaced by two masses, these two masses connected by a very stiff spring $k_2$. This system can be solved in a similar way, by writing down the potential energy and again solving a matrix equation for normal mode frequencies. However for our discussions here, the results can be understood qualitatively as well. The soft-spring—mass system has similar normal modes to those of the original system. However, the additional stiff springs oscillate at much higher frequencies (again, at a variety of wavelengths). This leads to two distinct vibration bands as a function of inverse wavelength—one primarily due to the soft springs, and one to the stiff springs. The important feature here is that there is a bandgap in the spectrum between these two behaviors: at intermediate frequencies, no waves propagate (and are instead reflected back into the duct). This effect may be simulated by varying the foam density through the foam member, or by adding adjacent layers of foam having at least a differing stiffness, density, cell sizes, wall thickness, etc.

Additionally and optionally an elastic non-porous layer may be arranged around the foam preferably at the outlet end of the broadcast duct. This non-porous layer may have a density selected (for example a higher density than the foam) to selectively dampen higher frequency components of the transmitted sound.

DEFINITIONS

Acoustic Impedance: Sound travels through a material by transferring sound pressure. The atoms and molecules of the medium are bound together elastically and therefore, excess sound pressure results in wave propagating through the medium. Thus, sound propagation depends on the resistance that needs to be overcome and the reactance of the medium to the incident sound wave. Or, in other words, impedance of a medium depends on the density/mass and stiffness of the medium (resistance) and frequency/velocity of incident wave (reactance).

Cell: Refers to an air cavity contained in the foam media. A cell is closed when the cell membrane surrounding the cavity or enclosed opening is not perforated and has all membranes intact. Cell connectivity occurs when at least one wall of the cell membrane surrounding the cavity has orifices or pores that connect to adjacent cells, such that an exchange of fluid is possible between adjacent cells. Open pore foams are generally considered better for sound dampening.

Sound dampening: The process by which sonic vibrations are converted into heat over time and distance in the sound characterization device (ex: foam). This can be achieved in several ways. One way is to modify the material density and/or cell/void density of the foam. Another way is to add additional foam layer(s) of foam or other material having a higher density. Referring to FIG. 3B, for example, the sound characterization device 54 may comprise a first soft foam layer 54B and a more dense layer 54A arranged back to back (in serial fashion). The higher density layer 54A is actuated by sound waves transmitted through the softer layer 54B and the increased density acts to modify the frequency spectral response of the transmitted sound, specifically by passing lower frequencies more readily than higher frequencies.

The frequency spectral response and sound dampening level of a particular sound characterization device can be calibrated by varying the composition of the foam, varying the cell size, the cell wall thickness, the density distribution (determined by the size and location and wall thickness of cells in the foam), the cell open ratio of the foam (fractional number of cells having open walls), the stiffness of the foam, the material density of the foam material, the thickness of the layer(s) of the foam, and by adding additional; foam layers having differing properties (as outlined above).

Advantageously, a variety of sound characterization devices each having differing spectral frequency responses and sound dampening characteristics may be made available to an end user or customer. The end user or customer is thereby enabled to selectively and relatively uniquely tune the sound transmission characteristics of the sound transmission device to provide a desired and pleasing engine sound (such as an engine rumble sound) to the occupants of the vehicle passenger compartment according to personal preferences.

Advantageously, the individual tuning of the transmitted sound may be accomplished by the end user without the need for an expensive and complicated active sound transmission system. Such advantageous provisions are not taught in the prior art and are particularly beneficial.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A tunable sound transmission device for transmitting an engine rumble sound into an interior of a motor vehicle, comprising:

a transmission line having a first end and a second end, wherein said first end is in acoustic communication with an air intake tract of an engine;

a flexible membrane sealably closing off a portion of said transmission line thereby dividing said transmission line into two portions that are airflow isolated from each other, said membrane operable to communicate sound between said portions;

a receptacle arranged at said second end of said transmission line;

a sound characterization device replaceably installed into said receptacle, said sound characterization device having an intended frequency dependent sound attenuation characteristic and an overall sound dampening level;

wherein said sound characterization device is tunable by replacing said sound characterization device with another sound characterization device having at least a differing one of said frequency dependent sound attenuation characteristic and desired overall sound dampening level.

2. The tunable sound transmission device of claim 1, wherein said receptacle is arranged within a passenger compartment of a motor vehicle to deliver said engine rumble sound therein.

3. The tunable sound transmission device of claim 1, wherein said sound characterization device comprises polyurethane foam.

4. The tunable sound transmission device of claim 3, wherein said sound characterization device is calibrated to achieve said desired frequency dependent sound attenuation characteristic and said desired overall sound dampening level by adjusting at least one of: foam material composition, cell size, cell open ratio, thickness, stiffness, total air volume in said foam, and foam material density.

5. The tunable sound transmission device of claim 4, wherein said sound characterization device comprises at least one additional foam layer positioned in series with first foam layer, said additional foam layers each having a at least one different one of said foam material composition, cell size, cell open ratio, thickness, stiffness, total air volume in said foam, and foam material density relative to other layers;

wherein said additional layers are operable to further characterize said frequency dependent sound attenuation characteristic and said desired overall sound dampening level.

6. The tunable sound transmission device of claim 5, wherein at least one of said additional layers are operative to provide at least one bandgap in said transmitted sound frequency spectrum, said bandgap calibrated to attenuate undesired sound frequencies.

7. A tunable sound transmission device for transmitting an engine rumble sound into an interior of a motor vehicle, comprising:

a transmission line having a first end and a second end, wherein said first end is in acoustic communication with an air intake tract of an engine;

a flexible membrane having a sound transmitting portion and a mounting portion, said membrane arranged at and having a first side closing off said second end of said transmission line;

a sound broadcast duct including:

a mouth at a first end of said broadcast duct, said mouth sized and configured to close against and receive sound from an opposing second side of said membrane, said duct arranged to transmit said engine rumble sound towards said interior of said motor vehicle;

a receptacle arranged at an opposing second end of said broadcast duct;

a carrier cage sized and configured for removable installation into said receptacle; and a sound characterization device replaceably installed into said carrier cage, said sound characterization device having an intended frequency dependent sound attenuation characteristic and an overall sound dampening level;

wherein said sound characterization device is end user changeable by replacing with another sound characterization device having at least a differing one of said frequency dependent sound attenuation characteristic and desired overall sound dampening level.

8. The tunable sound transmission device of claim 7, wherein said second end of said sound broadcast duct is arranged within a passenger compartment of a motor vehicle to deliver said engine rumble sound therein.

9. The tunable sound transmission device of claim 7, wherein said sound characterization device comprises polyurethane foam.

10. The tunable sound transmission device of claim 9, wherein said sound characterization device is calibrated to achieve said frequency dependent sound attenuation characteristic and said desired overall sound dampening level by adjusting at least one of: foam material composition, cell size, cell open ratio, thickness, stiffness, total air volume in said foam, and foam material density.

11. The tunable sound transmission device of claim 10, wherein at least one of said transmission line and said broadcast duct have a length or air volume selected to resonantly emphasize at least one frequency band of said transmitted engine sound relative to other frequencies;

wherein said membrane further tunes said transmitted engine sound, said tuning provided by adjusting at least one of: membrane material, membrane size, membrane density, membrane thickness, membrane stiffness, membrane tensioning; and wherein said sound characterization device is replaceably tunable to provide further characterization of said transmitted engine sound.

12. The tunable sound transmission device of claim 10, wherein said sound characterization device comprises at least one additional foam layer positioned in series with first foam layer, said additional foam layers having at least one different one of said foam material composition, cell size, cell open ratio, thickness, stiffness, total air volume in said foam, and foam material density relative to other foam layers;

wherein said additional layers are operable to further characterize said frequency dependent sound attenuation characteristic and said desired overall sound dampening level.

13. The tunable sound transmission device of claim 12, wherein at least one of said additional layers are operative to provide at least one bandgap in said transmitted sound frequency spectrum, said bandgap calibrated to attenuate undesired sound frequencies.

* * * * *